US005816213A

United States Patent [19]

Gaviani et al.

[11] Patent Number: 5,816,213

[45] Date of Patent: Oct. 6, 1998

[54] INTEGRATED FUEL AND COMBURENT FEED ASSEMBLY

[75] Inventors: Giovanni Gaviani, Rimini; Walter D'Avanzo, Bologna, both of Italy

[73] Assignee: Magneti Marelli S.p.A., Milan, Italy

[21] Appl. No.: 837,670

[22] Filed: Apr. 22, 1997

[30] Foreign Application Priority Data

Apr. 22, 1996 [IT] Italy ..... B096A0214

[51] Int. Cl.[6] ..... F02B 77/00

[52] U.S. Cl. ..... 123/198 E; 123/456; 123/184.42

[58] Field of Search ..... 123/184.42, 184.57, 123/184.61, 456, 195 C, 198 E

[56] References Cited

U.S. PATENT DOCUMENTS

| | | | |
|---|---|---|---|
| 5,003,933 | 4/1991 | Rush, II et al. | 123/184.61 |
| 5,150,669 | 9/1992 | Rush | 123/52 |
| 5,353,767 | 10/1994 | Carbone | 123/470 |
| 5,357,931 | 10/1994 | Semence | 123/184.61 |
| 5,477,819 | 12/1995 | Kopec | 123/184.42 |
| 5,653,200 | 8/1997 | Hafner et al. | 123/184.61 |
| 5,664,533 | 9/1997 | Nakayama et al. | 123/184.61 |

FOREIGN PATENT DOCUMENTS

| | | |
|---|---|---|
| 0294083 | 12/1988 | European Pat. Off. . |
| 0664390 | 7/1995 | European Pat. Off. . |
| 4403219 | 8/1995 | Germany . |

*Primary Examiner*—Thomas N. Moulis
*Attorney, Agent, or Firm*—Baker & Daniels

[57] ABSTRACT

The fuel and comburent feed assembly of a combustion engine comprises a container having an internal chamber and housing an intake manifold of the engine, a filtration element of the comburent, a multiplicity of injection devices of the fuel to the intake pipes of the engine, a throttled body arranged at the inlet of the manifold to regulate the inflow of the comburent inside the manifold itself, sensors for measuring quantities essential to the operation of the engine, and an electronic unit for controlling the injection devices according to the data recorded by sensors.

8 Claims, 2 Drawing Sheets

INTEGRATED FUEL AND COMBURENT FEED ASSEMBLY

BACKGROUND OF THE INVENTION

The present invention relates to an integrated fuel and comburent, i.e., ambient air, feed assembly.

The description which follows will explicitly refer to a fuel and comburent feed assembly of a combustion engine for motor vehicles, without thereby losing generality.

As is known, combustion engines for motor vehicles are currently provided with fuel and ambient air feed assemblies that are substantially independent of one another. In particular, the comburent feed assembly comprises a comburent intake manifold, directly connected to a multiplicity of intake pipes produced inside a cylinder head of the engine, and a filtration unit for the comburent itself, communicating with the intake manifold by means of a connecting pipe.

The intake manifold comprises a main pipe, communicating with the filtration unit by means of the connecting pipe, and a multiplicity of secondary pipes extending from the main pipe and each connecting the main pipe itself to a respective intake pipe in the engine's cylinder head.

The comburent feed assembly further comprises at least one throttled body, arranged inside the main pipe of the intake manifold upstream of the secondary pipes, which is suitable for regulating the amount of comburent which flows inside the intake pipes.

In contrast the fuel feed assembly comprises a multiplicity of injectors, each of which is suitable for introducing inside the respective intake pipe a specific amount of fuel per engine cycle, and a supply pipe, also known as a "flute" ["flauto" in Italian], suitable for supplying pressurized fuel to each injector. The fuel feed assembly also comprises a multiplicity of sensors for gathering data essential to the operation of the engine, such as the quantity and temperature of the comburent which flows inside the intake pipes, and an electronic unit which controls each injector and determines, on the basis of the data recorded by the sensors, the amount of fuel and the moment at which that amount should be introduced into each intake pipe.

The need to arrange an ever-increasing number of devices inside an engine compartment of the motor vehicle has actually imposed the need to position some components of the feed assemblies inside protection containers which are frequently arranged in positions which are particularly narrow and relatively distant from the engine, complicating the architecture of the said feed assemblies. The electronic unit, for example, is generally arranged in a protected position relatively far away from the engine and is connected to the injectors and to the sensors by means of cables of considerable length, which is often the cause of malfunctions.

SUMMARY OF THE INVENTION

The object of the invention is therefore to produce fuel and comburent feed assemblies which can eliminate the above-mentioned disadvantages.

According to the present invention an integrated fuel and comburent feed assembly is produced which is suitable for supplying fuel and comburent to at least one intake pipe of a combustion engine, comprising means for feeding the comburent to the said intake pipe, means for filtering the said comburent, and means for supplying the fuel to the said intake pipe; and being characterized in that it comprises a container housing at least the said feed means, the said filtration means, the said supply means, and sensors for recording quantities essential to the operation of the engine.

Preferably the integrated assembly described above is characterized in that the said container houses an electronic control unit.

BRIEF DESCRIPTION OF THE DRAWINGS

The invention will now be described with reference to the accompanying drawings which illustrate a non-restrictive embodiment thereof and in which.

DETAILED DESCRIPTION OF THE INVENTION

Figure 1:
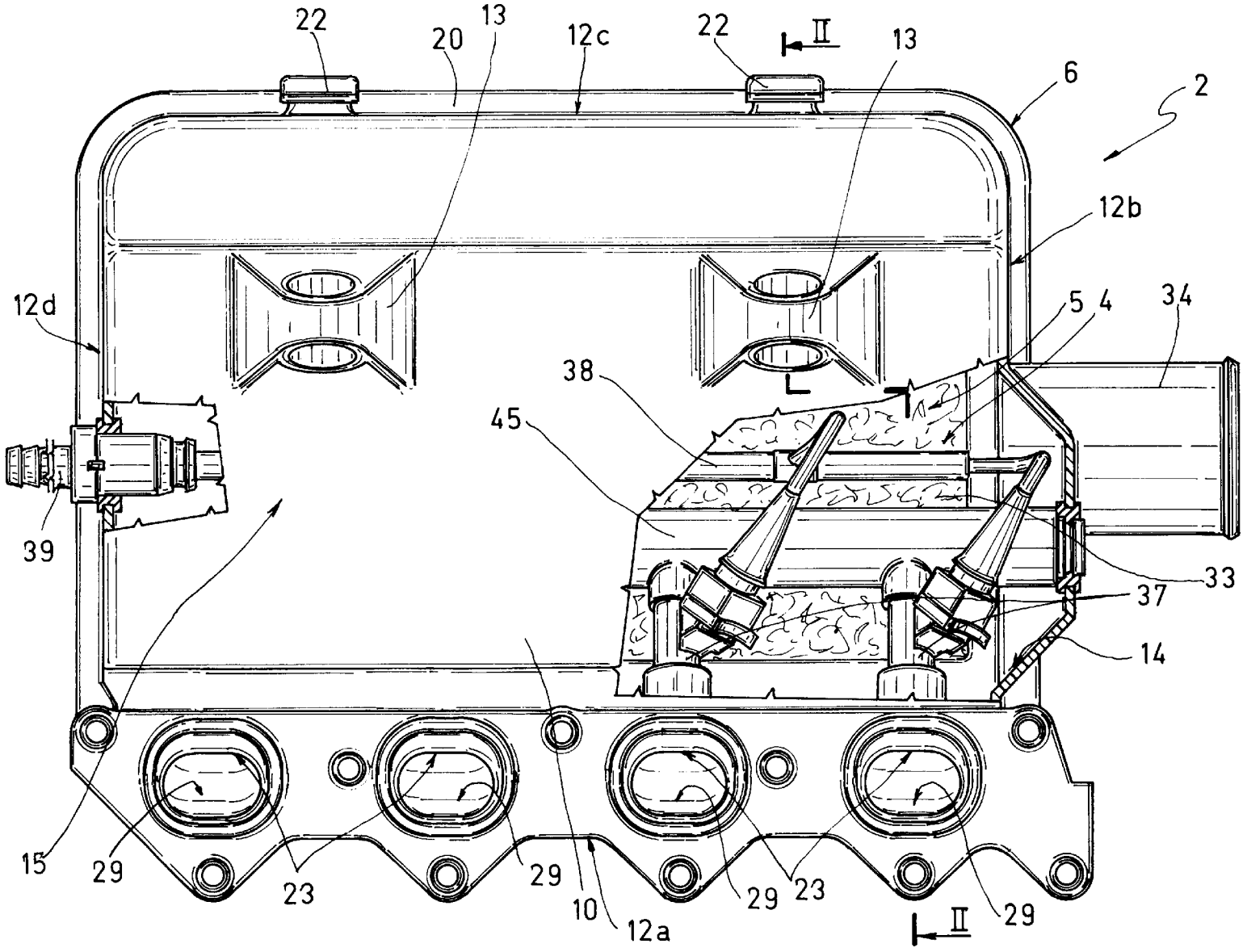
FIG. 1 shows in a frontal elevation, with parts in section and parts removed for reasons of clarity, a preferred embodiment of the assembly of the invention.
Figure 2:
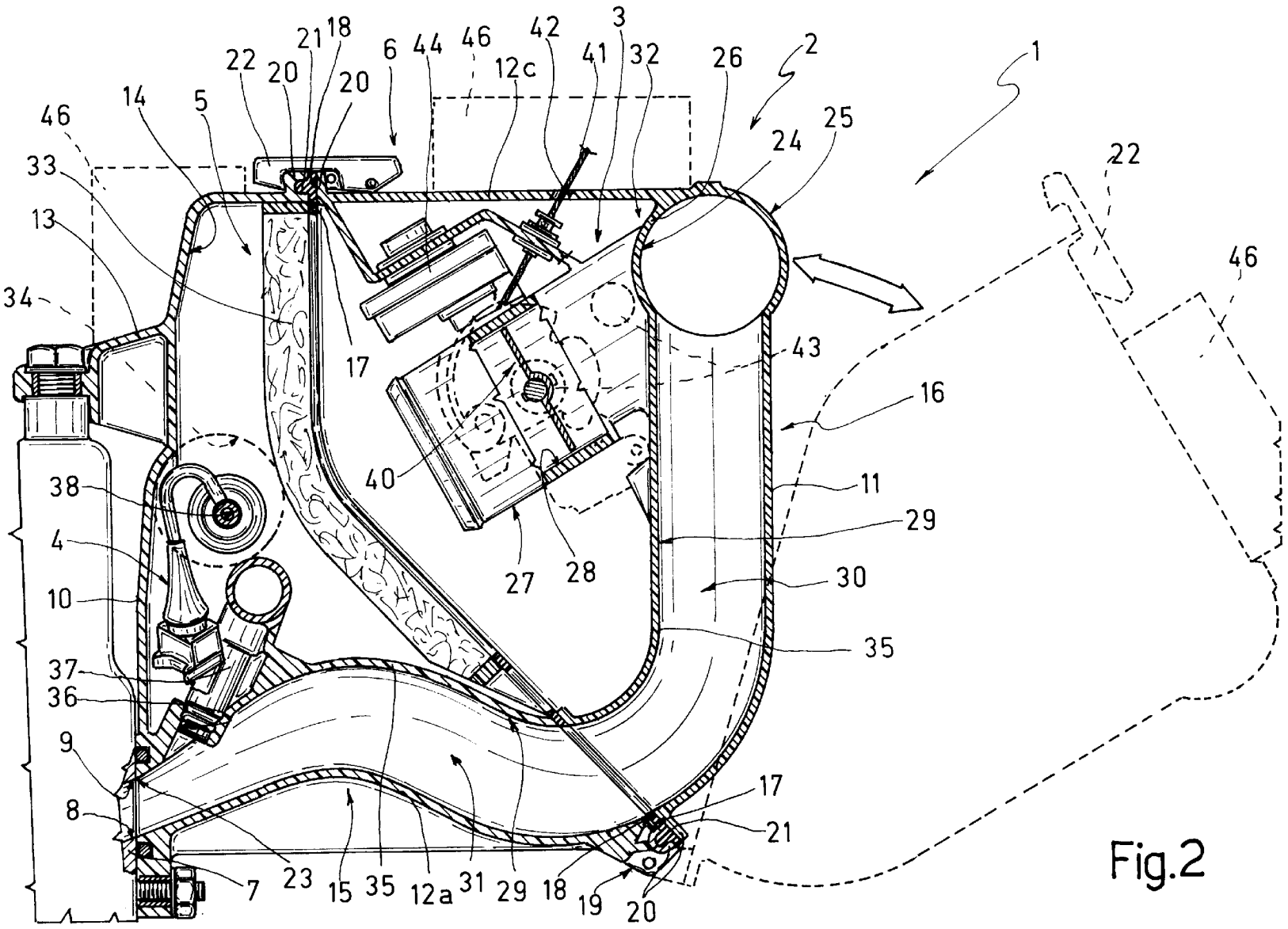
FIG. 2 shows a section according to II—II of FIG. 1.

With reference to FIGS. 1 and 2, in its entirety 1 denotes a combustion engine preferably but not necessarily for motor vehicles, which is provided with a fuel and comburent feed unit 2 which comprises a comburent feed assembly 3, a fuel feed assembly 4 and finally a filtration assembly 5 for the said comburent.

The unit 2 also comprises a container 6, housing the assemblies 3, 4 and 5, which is suitable for being mounted integral with a wall 7 of the engine 1 having a multiplicity of apertures, each of which defines an inlet 8 of a respective intake pipe 9 of the engine 1 itself. The container 6 has a substantially parallelepipedal shape and has a front wall 10 arranged in contact with the wall 7 of the engine 1, a rear wall 11 parallel to and facing the wall 10 and finally four lateral walls, denoted by 12*a,* 12*b,* 12*c* and 12*d,* which are perpendicular to the walls 10 and 11 and are in parallel pairs perpendicular to each other.

In the example shown, the container 6 is suitable for being mounted on the engine 1 by means of support brackets 13 which extend from the wall 10 to the outside of the container 6 perpendicular to the said wall 10.

The container 6 has an internal chamber 14 and is defined by two mutually complementary shell portions 15 and 16 which have respective perimeter end edges 17 and 18 suitable for being coupled together in a fluid-tight manner and in an easily uncouplable way; the wall 10 of the container 6 belongs to the portion 15 whilst the wall 11 belongs to the portion 16.

In the example shown, the portions 15 and 16 of the container 6 are connected together by means of a hinge 19 and the portion 16 of the container 6 is movable between a closed configuration and an open configuration which permits access to the inside of the said container 6.

Along the respective perimeter edges 17 and 18 the portions 15 and 16 have respective connection flanges 20 between which a gasket 21 is interposed, and furthermore the portion 16 is provided externally with a multiplicity of coupling devices 22, suitable for mechanically connecting the portions 15 and 16 to each other, and for keeping the flanges 20 clasped on the gasket 21.

With reference to FIG. 2, the container 6 is mounted on the engine 1 in such a way that the wall 10, having a multiplicity of apertures 23 (see FIG. 1) is arranged with each aperture 23 aligned to a respective inlet 8 of an intake pipe 9.

Inside the container 6, the assembly 3 comprises a main, substantially cylindrical pipe 24 which extends inside the container 6 parallel to a corner 25 of the said container 6 defined by the walls 11 and 12*c*. The pipe 24 is sealed at both ends and is arranged inside the portion 16 of the container 6 with its own lateral wall 26 integral with the walls 11 and 12*c* of the said container 6.

Inside the container 6 the assembly 3 further comprises a tubular body 27 which extends from the wall 26 of the pipe 24 towards the centre of the chamber 14 and has an internal cavity 28 which connects the pipe 24 to the chamber 14, and a multiplicity of secondary pipes 29, each of which connects a respective aperture 23 to the main pipe 24. In the example shown each secondary pipe 29 is sub-divided into two portions 30 and 31, coupled together in a fluid-tight manner, each of which is integral with a respective shell portion 15, 16 of the container 6. In particular, the portion 30 of the pipe 29 is integral with the wall 11 whilst the portion 31 of the pipe 29 is integral with the walls 10 and 12*a* of the container 6.

Inside the container 6 the main pipe 24, the tubular body 27 and the secondary pipes 29 define an intake manifold 32 of the assembly 3 suitable for supplying comburent to the intake pipes 9 of the engine 1.

With reference to FIG. 2, the comburent supply assembly 3 also has a throttled body 40 which is housed inside the cavity 28 of the tubular body 27 and is suitable for regulating the inflow of comburent inside the main pipe 24. The throttled body 40 is controlled in known manner by means of a cable 41 which arrives inside the container 6 through a slit 42 present in the wall 12*c*.

Inside the chamber 14 the filtration assembly 5 comprises a filtration element 33, arranged perpendicular to the walls 12*b* and 12*d*, which sub-divides the chamber 14 into two half-chambers each of which is limited by a respective shell portion 15, 16 of the container 6 itself. The half-chamber relative to the portion 15 of the container 6 communicates with the outside through a pipe 34 extending from the wall 12*b* of the said container 6.

In the vicinity of the relative aperture 22, on a wall 35 of its own, each secondary pipe 29 has a respective through seat 36, and the fuel feed assembly 4 has an injection device 37, of known type, housed inside each seat 36. The injection devices 37 are arranged inside the chamber 14 and are suitable for introducing the fuel into the pipes 29.

Inside the chamber 14 the assembly 4 further has a fuel supply pipe 38 which is connected to each injection device 37 and is suitable for receiving the pressurized fuel from outside the container 6 to supply it to each device 37, and optionally also a drain pipe (not shown) for discharging surplus fuel.

The supply pipe 38 extends perpendicular to the walls 12*b* and 12*d* inside the half-chamber relative to the portion 15 of the container 6 and is connected to the outside of the container 6 via a sleeve 39 projecting from the rear wall 12*d*.

The container 6 is provided internally with a multiplicity of sensors 43 for gathering data essential to the operation of the engine 1, such as the amount and temperature of the comburent which flows inside the intake pipes 9, and with an electronic unit 44, housed in the chamber 14, which is connected by means of cables (not shown) to the sensors 43 and to the injection devices 37 and controls each device 37 to determine, on the basis of the data recorded by the sensors 43, the amount of fuel and the moment at which that amount should be introduced into each intake pipe 9.

In the example shown the cables reach the injection devices 37 inside a protective sheath 45 which extends inside the chamber 14 parallel to the fuel supply pipe 38 above the said devices 37.

Finally, the container 6 is preferably but not necessarily provided with resonator devices 46 which are arranged upstream and downstream of the filtration element 33 in communication with the chamber 14 and are suitable for reducing the noise produced during the intake of the comburent.

According to a first variant which is not shown, the comburent feed assembly 3 has a multiplicity of throttled bodies 40 each housed inside a respective secondary pipe 29 of the intake manifold 32.

According to a second variant which is not shown, the throttled body 40 is controlled by means of an electronic control device (not shown) which is controlled by the electronic unit 44 of the engine 1 which directly controls the inflow of comburent into the intake pipes 9 of the engine 1.

According to a further variant which is not shown, the container 6 does not have the electronic unit 44 of the engine 1, which is arranged externally to the said container 6, and has an electronic unit (not shown) for controlling the sensors 43 which is arranged inside the chamber 14 and is connected to the electronic unit 44.

The operation of the assembly 1 can easily be inferred from the above description and does not therefore require further explanation.

The advantages deriving from the unit 2 described above are essentially a high degree of integration of the components, a reduction of the dimensions inside the engine compartment of the motor vehicle and a reduction of the operations required for mounting the said unit 2 onto the remaining part of the engine 1.

Finally, it will be evident that it is possible to introduce modifications to and variants of the unit 2 described and illustrated here without thereby departing from the scope of the present invention.

We claim:

1. An integrated fuel and comburent feed assembly (2) suitable for supplying fuel and comburent to at least one intake pipe (9) of a combustion engine (1), comprising means for feeding the comburent (3) to the said intake pipe (9), means for filtering (5) the said comburent, and means for supplying (4) the fuel to the said intake pipe (9); and being characterized in that said feed assembly comprises a container (6) housing at least the said feed means (3), the said filtration means (5), the said supply means (4), and sensors (43) for recording quantities related to the operation of the engine (1), wherein said container is defined by at least two shell portions (15, 16) that are hinged together in correspondence with one of their ends, and said container further comprises elements (22) suitable for making the shell portions integral with one another.

2. An assembly according to claim 1, characterized in that the said container (6) houses an electronic control unit (44).

3. An assembly according to claim 1, characterized in that the said shell portions (15, 16) are coupled together in a fluid-tight manner and in an easily uncouplable way.

4. An assembly according to claim 1, characterized in that the said container (6) has an internal chamber (14) communicating with the outside through at least one aperture (34) on the container (6), and the said feed means (3) communicate with the said internal chamber (14).

5. An assembly according to claim 4, characterized in that the said filtration means (5) comprise a filtration element (5) arranged inside the chamber (14) interposed between the said feed means (3) and the said aperture (34).

6. An assembly according to claim 4, characterized in that the said container (6) comprises resonator devices (46)

communicating with the said internal chamber (14) and suitable for reducing the noise produced by the passage of the comburent.

7. An assembly according to claim 4, characterized in that the said fuel supply means (4) are housed inside the said internal chamber (14).

8. An assembly according to claim 1, characterized in that the said feed means (3) comprise first (24, 27, 30, 40) and second (31) feed elements, each integral with a respective shell portion (15, 16) of the said container (6), the said first (24, 27, 30, 40) and second (31) feed elements being coupled together in a fluid-tight manner and in an uncouplable way.

* * * * *